United States Patent [19]

Franc

[11] 3,941,346

[45] Mar. 2, 1976

[54] TIE ROD ASSEMBLY INCLUDING RESILIENT SEALING AND SPACING MEANS

[75] Inventor: Eugene K. Franc, San Anselmo, Calif.

[73] Assignee: Construction Engineering Products, San Rafael, Calif.

[22] Filed: Sept. 13, 1974

[21] Appl. No.: 505,728

[52] U.S. Cl. ..... 249/40; 249/217

[51] Int. Cl.[2] ..... E04G 17/08

[58] Field of Search ..... 249/40, 41, 43–47, 249/190, 191, 213, 214, 216, 217

[56] References Cited

UNITED STATES PATENTS

| | | | |
|---|---|---|---|
| 915,995 | 3/1909 | McCarty | 249/217 |
| 1,851,339 | 3/1932 | Williams | 249/42 |
| 1,875,136 | 8/1932 | Podd | 249/213 |
| 2,001,052 | 5/1935 | Colt | 249/217 |
| 2,168,990 | 8/1939 | Hungerford | 249/46 |
| 3,013,323 | 12/1961 | Williams | 249/217 |
| 3,430,913 | 3/1969 | Johnson | 249/217 |
| 3,618,887 | 11/1971 | Eriksson | 249/190 |
| 3,632,724 | 1/1972 | Hilgeman, Jr. | 249/40 |
| 3,801,061 | 4/1974 | Holt | 249/217 |

FOREIGN PATENTS OR APPLICATIONS

| | | | |
|---|---|---|---|
| 1,930,028 | 12/1970 | Germany | 249/43 |

*Primary Examiner*—R. J. Shore
*Assistant Examiner*—John McQuade
*Attorney, Agent, or Firm*—Phillips, Moore, Weissenberger

[57] ABSTRACT

A seal member is provided for use in concrete wall form construction which sealingly engages with a form bore through which a tie rod supporting the seal member and spacer cones passes so as to prevent leakage of wet concrete from the form. The seal member of resilient material is asymmetrically supported on the tie rod by means of a seal bore within a slit along the length of the seal member. The asymmetric placement causes the spacer cones to overlap and abut the inner surface of the form walls so that they serve as spreaders for location of the wall forms.

5 Claims, 14 Drawing Figures

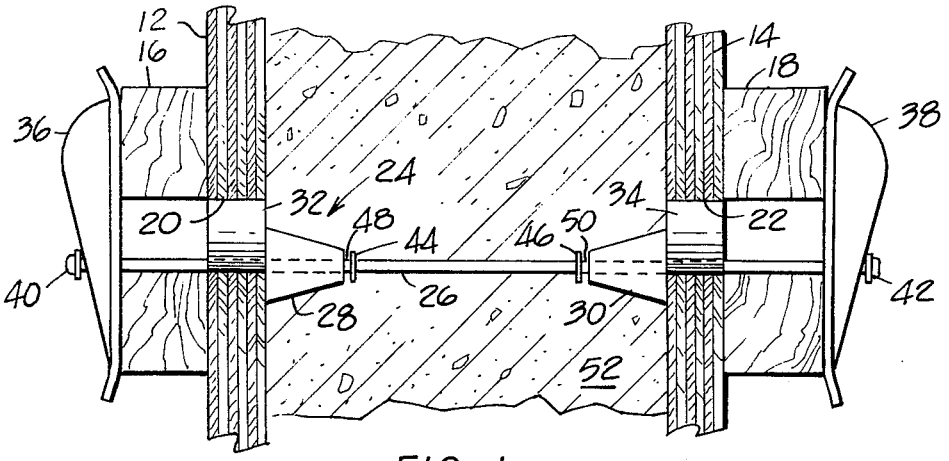
FIG. 1.
FIG. 2.
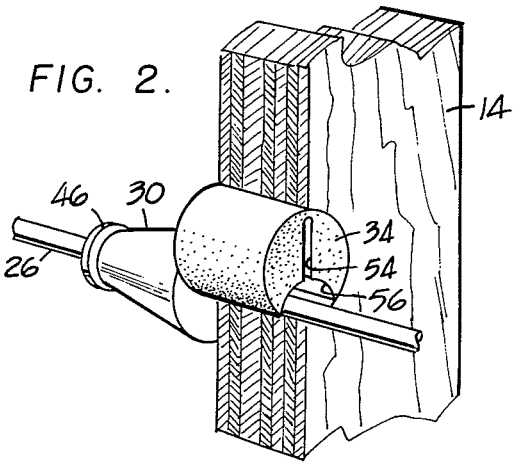
FIG. 3.
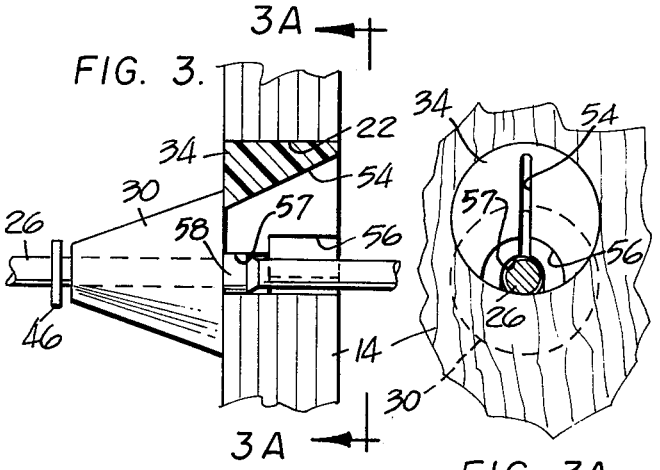
FIG. 3A
FIG. 4.
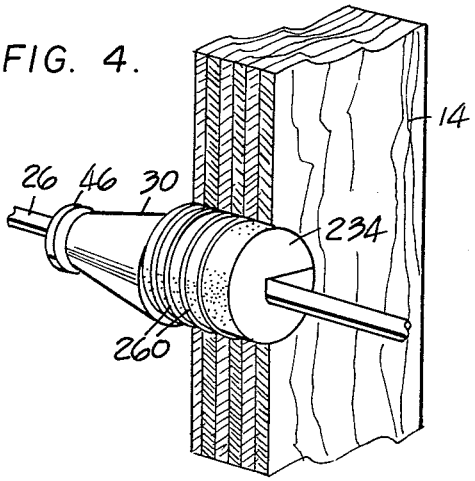
FIG. 5.
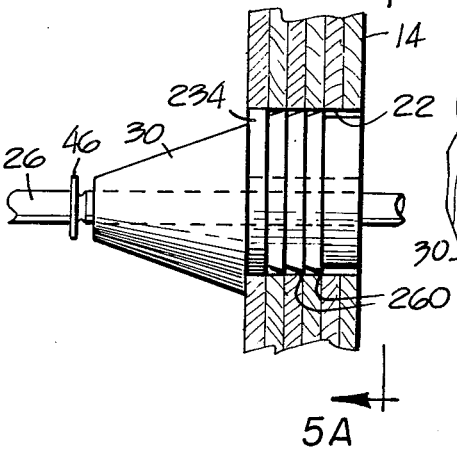
FIG. 5A
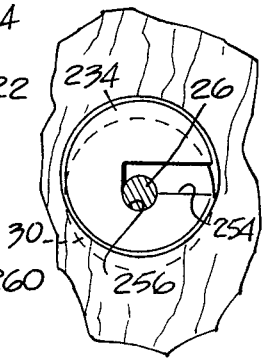

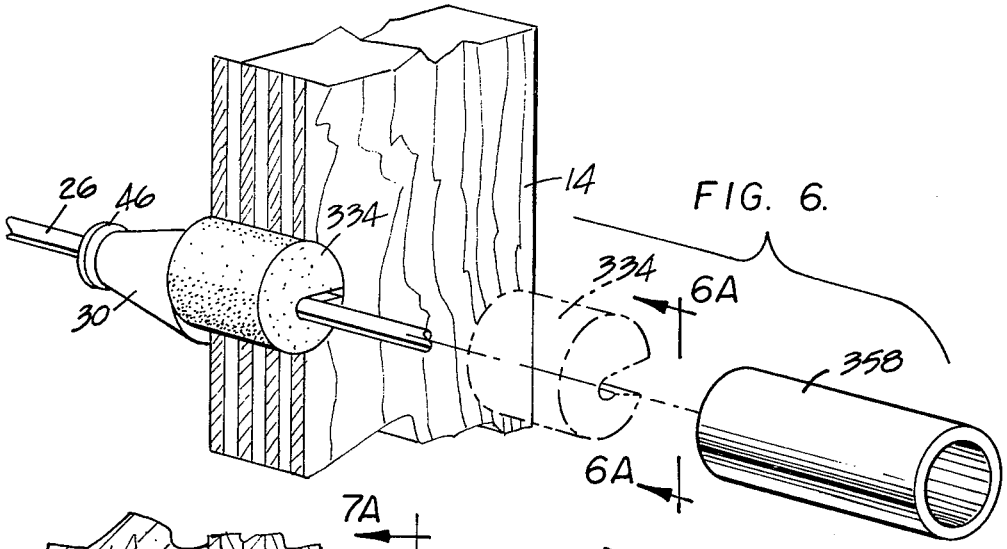
FIG. 6.
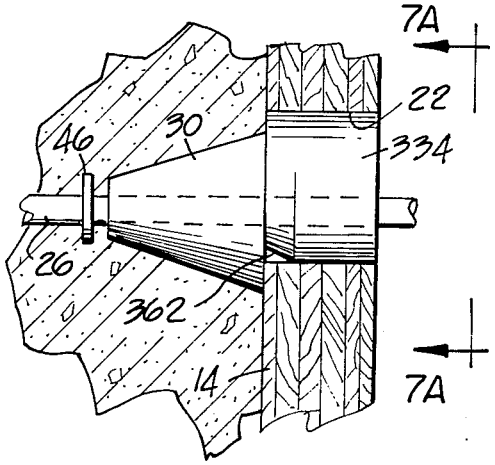
FIG. 7.
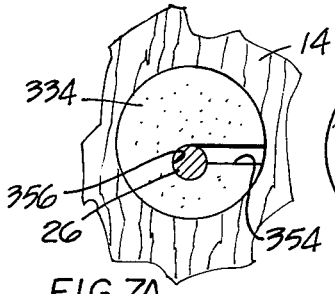
FIG. 7A.
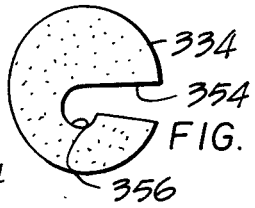
FIG. 6A.
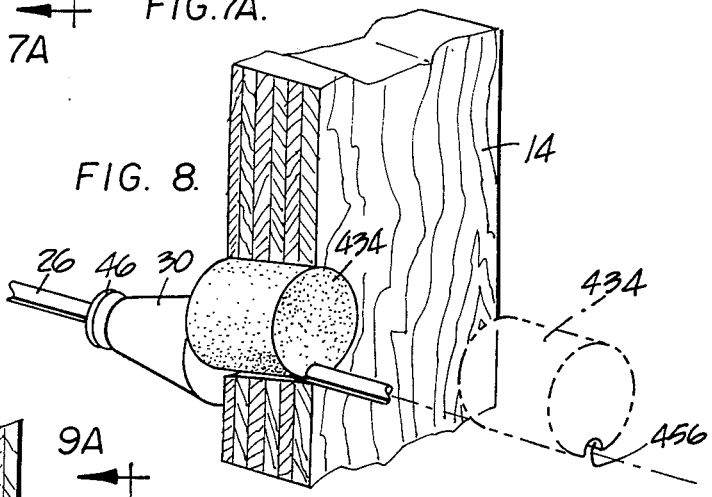
FIG. 8.
FIG. 9.
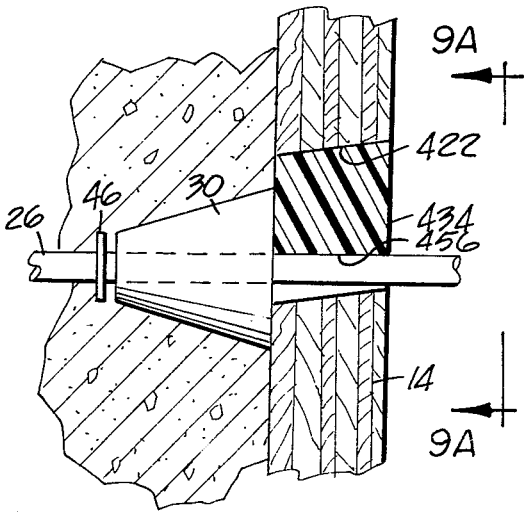
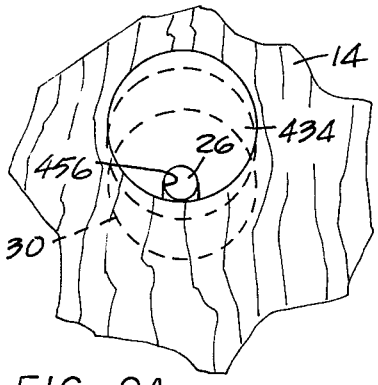
FIG. 9A.

TIE ROD ASSEMBLY INCLUDING RESILIENT SEALING AND SPACING MEANS

BACKGROUND OF THE INVENTION

This invention is related to tie rods for use in concrete wall form construction to hold the walls in spaced relation for placement and curing of concrete. More particularly, this invention relates to seal members for use with the tie rods.

In concrete wall form construction, generally plannar walls made of wood are oriented in spaced, generally parallel relation to act as a mould for subsequent receiving of wet concrete. Steel reinforcing bars may be, and in fact often are placed between the walls to add integrity to the finished wall structure. The walls are temporarily held together by cone and tie assemblies comprised of tie rods, cones or insert members and form dogs which are typically wedge shaped structures. The tie rods are inserted through aligned bores in the walls so that the ends thereof extend exterior to the wall for clamping. Frustoconically shaped insert members or cones are located on the tie rods between stops thereon and the wall interior surface for the purpose of maintaining spacing of the walls as well as forming depressions in the finished wall about the tie rod. The depressions thus formed enable breaking off the tie rods within the wall and subsequent grouting to the finished surface which is free from protruberances or other discontinuities. The forms are locked up by means of form dogs or wedges which are inserted between buttons or heads on the tie rod ends and wales on the form exterior.

A number of prior art patents illustrate parts of the structure referred to as follows: U.S. Pat. Nos. 2,245,559; 2,370,174; 2,728,127; 2,977,659; 3,075,272; 3,464,667; 3,482,813; 3,625,471; 3,643,909; and 3,653,628.

It has been found that one of the most persistent problems encountered with concrete wall form construction thus described is that of sealing of the wall form bores through which the tie rods pass to prevent egress of wet concrete and moisture. Wet concrete is made up of a mixture of cement, aggregate, and water in desired proportions. The wet concrete when placed between the walls of the form tends to run out the wall form bores, producing undesirable results. One such result is the fouling of the exterior hardware such as dogs and wedges. The leaked material tends to "set up" on the surface of these structures which requires costly remedial cleaning procedures. Another result is the degredation in concrete wall strength since the moisture is needed for proper curing of the concrete during the time after placement. Still another result is the production of rough edges around the depressions in the finished wall formed by the cones. These rough edges must be laboriously removed by grouting with a grouting material. Other expensive post-casting operations in the form of finishing and cleaning are also required.

Some attempts to solve the leakage problem thus described may be found by having reference to the following patents; U.S. Pat. Nos. 2,370,174; 3,643,909; and 3,482,813, above-referenced. These attempts have not been entirely successful, however, for various reasons.

SUMMARY AND OBJECTS OF THE INVENTION

It is therefore the primary object of this invention to provide an improved seal member for concrete wall form construction which operates to prevent undesired leakage of concrete and moisture from wall forms.

It is a further object of this invention to provide a seal member which includes an offset so that the tie-rod insert or cone performs a spreader function to hold the walls of the form a fixed distance apart.

It is a further object to provide such a seal member device which is inexpensive, and yet easily installed and removed.

The invention is in the form of a generally cylindrical seal member of resilient material including a slit along its length and including therein an asymmetrically placed seal bore for closely accomodating the tie rod. In the preferred embodiment, the seal is expanded against the form bore.

Other objects and advantages will become more readily apparent from a review of the following description and drawings.

BRIEF DESCRIPTION OF THE DRAWINGS

FIG. 1 is a transverse cross-sectional view of a concrete wall form showing details of a tie-rod and cone assembly installed therein;

FIG. 2 is a top quarter isometric view in partial cross-section of a first embodiment of a seal member of the instant invention;

FIG. 3 is a side elevational view of the embodiment of FIG. 2;

FIG. 3A is an end elevational view taken along lines 3A—3A in FIG. 3;

FIG. 4 is a top quarter isometric view in partial cross-section of a second embodiment of the seal member of the instant invention;

FIG. 5 is a side elevational view of the embodiment of FIG. 4;

FIG. 5A is an end elevational view taken along lines 5A—5A in FIG. 5;

FIG. 6 is a top quarter isometric view in partial cross-section of a third embodiment exploded in phantom and showing installation details;

FIG. 6A is an end elevational view taken along lines 6A—6A in FIG. 6;

FIG. 7 is a side elevational view of the embodiment of FIG. 6;

FIG. 7A is an end elevational view taken along lines 7A—7A in FIG. 7;

FIG. 8 is a top quarter isometric view in partial cross-section of a fourth embodiment exploded in phantom;

FIG. 9 is a side elevational view of the embodiment of FIG. 8; and,

FIG. 9A is an end elevational view taken along lines 9A—9A in FIG. 9.

DETAILED DESCRIPTION

FIG. 1 shows the concrete wall form environment of the instant invention including tie rod and cone assembly and locking devices. Wall form 10 includes a pair of spaced, parallel walls 12,14 which may be of plywood material. Struts or wales 16,18 serve to back up and otherwise reinforce the walls. A pair of axially aligned wall form bores 20,22 of circular shape are included for insertion of tie rod and seal assembly 24.

Tie rod and seal assembly 24 in turn includes a generally cylindrical tie rod 26 of steel or other suitable material and having a pair of frustoconically shaped cones or insert members 28,30 and seal members 32,34 located thereon as will be now more fully described hereinafter. It should be noted that the term "cones" is meant to describe any number of geometric shapes that are suitable for the described purpose and is not to be limited to the frustoconical shape shown and described. Bifurcated wedges or dogs 36,38 are fitted between the wales and buttons or heads 40,42 on the tie rod ends to lock up the form. The frustoconically shaped cones or insert members 28,30 are positioned to overlap the corresponding bores 20,22 so as to provide a spreader function in conjunction with stops 44,46 on tie rod 26. Annular grooves 48,50 are provided adjacent the stops to enable breaking off of the tie rod end within the finished wall in the conventional manner. The spreader function serves to position the walls 12,14 a fixed distance apart, for subsequent placement of concrete 52 in the form.

Turning to FIGS. 2 and 3, there is shown a first, preferred embodiment of the instant invention. As with the following embodiments, the seal member may conveniently be made of resilient material such as rubber or plastic. The frustoconically shaped cone or insert member 30 abuts seal member 34 and stop 46. With particular reference to FIGS. 3 and 3A, seal member 34 comprises a generally cylindrical body for sealing within wall form bore 22. The seal member 34 may be laterally positioned on the tie rod. It consists of a symmetrically placed longitudinal slit 54 extending the length and from half to almost the full diameter of the body, and leading to an asymmetrically placed seal bore 57 which is stepped and dimensioned to closely accomodate the tie rod at the forward end thereof. The asymmetric placement of the seal bore causes the lower edge of cone 30, which is symmetrically placed with respect to the rod, to overlap the inner form wall 14 and provide a spreader function.

As may be best seen in FIG. 3, slit 54 is narrower at its forward end in order that cone 30 will serve to obturate the slit and prevent egress of wet concrete and moisture from the form. The semicircular relieved portion 56 of bore 57 provided in the rear end of seal 34 is to accomodate the tie rod button (not shown) when the seal is axially at its rearmost position on the rod. A ramp shaped projection or bossed portion 58 on the tie rod with a larger diameter than seal bore 57 causes the seal to expand due to slit 54 or similar accomodation depending on resiliency of material used to sealingly engage bore 22 when the seal is in place in the form bore as shown.

In operation, the tie rod with cones thereon is inserted through one of the form bores and positioned so that the lower edge of the cones overlaps the form. The seal 34 is then moved laterally onto the rod 26 so that its accomodating bore 57 receives the rod. The seal is then advanced axially on the rod until it abuts the cone 30 and is sealingly engaged within the bore 22 by means of the radial expansion imparted thereto by the ramp shaped projection 58. The steps are repeated to install the other seal at the opposite end of the rod.

Turning to FIGS. 4 and 5 there is shown a second embodiment of the invention wherein seal member 234 is similarly laterally positioned onto rod 26 by means of longitudinal slit 254 which extends the length and approximately half the width of the body of seal 234. A bore 256 for accomodating the rod is included at the innermost portion of the slit and asymmetrically placed with respect to the body axis for the reasons as aforementioned with the primary embodiment. The generally cylindrical seal body has a plurality of annular serrations 260 thereon for sealing within form bore 22. The serrations are dimensioned to be of a diameter slightly greater than that of the form bore and may be unidirectional, as shown, to facilitate installation of the seal within the form bore. Installation is similar to that above described with respect to the primary embodiment in that the seal 234 is laterally placed and then axially advanced on rod 26 to its position within the form bore.

Turning to FIGS. 6 and 7 there is shown a third embodiment wherein, as best seen in FIG. 6A, the seal member 334 in its normal, relaxed condition is expanded beyond a circular shape. Like the previous embodiments, seal member 334 includes a longitudinal slit 354 and an asymmetric bore 356. A hollow cylindrical adapter 358 may be used to back up and retain seal 334 in place when using walers, etc. The seal 334 is laterally placed on rod 26 and then manually compressed until it attains a circular shape. Adapter 358 is then placed to abut the seal. The seal is then axially advanced by means of the adapter on the rod until it enters the bore. The seal will naturally expand to sealingly engage the bore. A chamfered forward edge 362 may be provided on the forward edge of the seal to aid in insertion.

FIGS. 8 and 9 show a fourth embodiment which is designed to be used with an angled bore 422 in the wall 14. The seal 434 comprises a generally cylindrical body having a longitudinal slit which forms a bore 456 along the length of the seal. With this embodiment, the generally cylindrical seal 434 is forced to assume the shape shown in FIG. 9 by the downwardly angled form bore 422. When the offset seal 434 is axially inserted, the tie rod is forced downward to position the lower edge of the cone 30 in its spreader function, while at the same time sealing pressure is exerted upwards against the bore to seal therein.

The form bore is angled with respect to the wall such that the seal member is forced downward to position the cone and deflect the rod. In this manner an upward pressure is exerted against the seal to seal the bore.

It is to be understood that the foregoing description is illustrative of preferred and alternate embodiments of the instant invention and that the scope of the invention is not to be limited thereto but is to be determined by the scope of the appended claims.

I claim:

1. In combination with a pair of spaced apart wall forms, a tie rod and seal assembly comprising a generally elongated tie rod defining a pair of opposite ends, each end of which extends through a respective wall form bore in a respective one of said spaced apart wall forms for positioning said wall forms, each end of said rod having mounted thereon a cone for forming a depression, said cone being positioned on said rod against the interior wall of its respective wall form, and a generally cylindrical seal member of resilient material having a means defining a longitudinal slit extending the length of said seal member and including therein an asymmetrically placed seal bore dimensioned so as to closely accomodate said tie rod, said slit leading to said asymmetrically placed seal bore, said seal member being located within a respective bore, and further including projection means on said rod for expanding said seal member against the interior of a respective bore.

2. The invention of claim 1 wherein said projection means is a tapered projection.

3. The invention of claim 1 wherein said means defining a slit further comprises an extension of said slit more than half of the diameter of said seal member.

4. The invention of claim 3 wherein said slit extension is angled so as to be obturated by said cone when in adjacent relation.

5. The invention of claim 3 wherein said seal member further includes a recess therein around said seal bore for accomodating a button on the rod end.

* * * * *